United States Patent [19]

Daly et al.

[11] Patent Number: 4,950,180

[45] **Date of Patent: * Aug. 21, 1990**

[54] ELECTRICAL TERMINATION AND METHOD OF TERMINATING FLAT POWER CABLE

[75] Inventors: John K. Daly, Scottsdale; Earl R. Kreinberg, Phoenix, both of Ariz.

[73] Assignee: AMP Incorporated, Harrisburg, Pa.

[ * ] Notice: The portion of the term of this patent subsequent to Aug. 22, 2006 has been disclaimed.

[21] Appl. No.: 382,604

[22] Filed: Jul. 19, 1989

Related U.S. Application Data

[63] Continuation of Ser. No. 193,852, May 13, 1988, Pat. No. 4,859,204.

[51] Int. Cl.[5] ..... H01R 4/24

[52] U.S. Cl. ..... 439/422; 439/421; 29/866

[58] Field of Search ..... 439/389, 391, 393, 409, 439/410, 417–419, 421–424; 29/863, 865, 866, 521, 522 R, 622, 432, 432.1, 432.2, 861; 174/94 R

[56] References Cited

U.S. PATENT DOCUMENTS

| | | | |
|---|---|---|---|
| 3,247,316 | 4/1966 | Weimer, Jr. . | |
| 3,728,473 | 4/1973 | Kuo | 439/424 |
| 3,881,796 | 5/1975 | Saunders | 439/422 |
| 4,012,101 | 3/1977 | Damoisioux | 439/422 |
| 4,059,897 | 11/1977 | Marquis . | |
| 4,082,462 | 4/1978 | Kinkaid et al. . | |
| 4,241,498 | 12/1980 | Brandeau . | |
| 4,326,764 | 4/1982 | Asick et al. . | |
| 4,602,831 | 7/1986 | Lockard . | |
| 4,655,515 | 4/1987 | Hamsher, Jr. et al. . | |
| 4,669,798 | 6/1987 | Daum et al. | 439/423 |

OTHER PUBLICATIONS

AMP Data Sheet, 74–279, Issued 7–84, "AMP Termi--FCI Terminals and Splices". AMP Incorporated, Harrisburg, PA, Ser. No. 07/049,631.

*Primary Examiner*—David L. Pirlot
*Attorney, Agent, or Firm*—Anton P. Ness

[57] ABSTRACT

A transition adapter for terminating flat power cable includes a stamped and formed member having opposed plate sections between which an end or an edge portion of the cable is receivable to be terminated where the plate sections have opposing cooperating terminating regions comprised of a plurality of alternating wave shapes and relief recesses, with each wave shape aligned with a recess of the opposing terminating region so that when the plate sections are urged together under sufficient force, the wave crests deflect integral strips of conductor cut of the plane of the cable, exposing sheared conductor edges for electrical connection therewith. Softer metal insert members are secured to and along outer surfaces of the plate sections and are then staked to deform the metal against the sheared conductor edges to engage and form gas-tight electrical connections of substantial surface area therewith. The terminating method can also include staking the wave joints to split them and force the split wave portions laterally, creating strong spring members against which the insert members can be staked for an improved electrical connection.

5 Claims, 10 Drawing Sheets

300
302
304
306
308
310
312
314
316
318
320
322
324
326
328
330
332
334
336
338

ELECTRICAL TERMINATION AND METHOD OF TERMINATING FLAT POWER CABLE

REFERENCE TO RELATED APPLICATION

This is a Continuation of U.S. patent application Ser. No. 07/193,852 filed May 13, 1988 now U.S. Pat. No. 4,859,204.

FIELD OF THE INVENTION

The invention relates to electrical terminals and more particularly to the termination of terminals to flat power cable.

BACKGROUND OF THE INVENTION

U.S. Pat. No. 4,834,673 discloses a transition adapter which is secured onto a flat power cable by being crimped thereto, and the adapter includes one or more contact sections to be engaged with corresponding contacts of an electrical connector to transmit power from the cable to the connector. The cable is of the type entering commercial use for transmitting electrical power of for example 75 amperes nominal, and includes a flat conductor one inch wide and about 0.020 inches thick with an extruded insulated coating of about 0.004 to 0.008 inches thick over each surface with the cable having a total thickness averaging about 0.034 inches. The metal of the flat conductor is for example of Copper Alloy 110 and the insulation is for example TEFZEL thermoplastic resin known as polyethylene-co-tetrafluoro-ethylene copolymer (trademark of the E. I. DuPont de Nemours and Company, Wilmington, Del.).

The transition adapter of U.S. Pat. No. 4,834,673 includes a pair of plate sections hinged together at the forward or terminal end of the adapter, and a still-insulated end or edge portion of the cable is to be crimped therebetween. At a selected location forwardly of the cable-crimping region at least one of the plate sections is bent at an angle away from the other so that the plate sections are facing each other at an angle and are thus spaced apart to receive the cable end or edge therebetween. A plurality of lances extend from one plate section toward corresponding apertures in the other so that upon pressing the plate sections together the lances penetrate through the cable. The lances are then received through the apertures and the ends thereof are bent over and against the outer surface of the other plate section, being bent over by tool means or by being curled around by integral arcuate guides at each aperture. By penetrating the cable a plurality of electrical connections are formed between the adapter and sheared conductor edges of the cable. By being stamped from sheet metal of an appropriate alloy, the lances are preferably defined by shear edges and penetrate through the insulation and also the conductor of the cable in cooperation with the lance-receiving apertures which preferably include at least one shear edge against which the cable is pressed during penetration by the lances. Additional electrical connections are made by a plurality of barbs which penetrate the cable insulation to engage and bite into the cable conductor.

It is desirable to provide an adapter having means for shearing through a flat power cable conductor at a plurality of locations and for providing a plurality of electrical connections between the adapter and the cable conductor wherein the connections are and remain gas-tight by reason of stored energy.

It is also desirable to provide each gas-tight connection with substantial surface area of engagement between the adapter and the cable's conductor.

It is still further desirable to provide an adapter with a portion being of a metal alloy capable of assuming a shape upon termination to the cable which maximizes surface area engagement with the sheared edges of the cable conductor while retaining stored energy to maintain the gas-tight nature of the connections during long-term in-service use.

The adapter of U.S. Pat. No. 4,867,700 is crimpable to a flat power cable by penetrating the insulation covering the cable's conductor and also shearing through the conductor at a plurality of locations. The adapter has a body member stamped and formed of sheet metal and has a pair of opposed plate sections each having at least one terminating region transversely thereacross, with the terminating regions of the opposed plate sections being associated in opposing pairs. Each terminating region of the pair is formed of alternating wave shapes and relief recesses, and the plurality of wave shapes of one plate section extend toward the other plate section and are spaced from each other by the relief recesses, with the wave shapes of one plate section corresponding with the relief recesses of the other. Each wave shape includes a transverse radiussed crest extending between parallel axially aligned shearing edges which are perpendicular with respect to the crest. Essentially the wave shapes of one plate section would intermesh with those of the other if urged toward each other, but preferably essentially with zero clearance.

The transition adapter is terminated to a cable disposed between the plate sections, by the preferably hingedly joined plate sections being pressed tightly together with the cable therebetween. Each wave shape will be forced against an adjacent surface portion of the cable and its crest will deflect that adjacent surface portion of the cable out of the plane of the cable and will stretch the conductor portion thus deflected. Simultaneously, the shearing edges of that wave shape cooperate with the shearing edges of the adjacent wave shapes of the opposed plate section: the shearing edges are aligned under zero clearance and pair up so that when the wave shapes are forced against the opposite surface of the cable, the paired shearing edges penetrate and tear the insulating layers and shear the conductor perpendicularly to the wave crest. Preferably an arcuate relief shape is formed at each relief recess extending away from the other plate section, and each wave shape is received into a corresponding opposed relief recess with the crest-deflected cable portion disposed between the wave's crest and the inner surface of the opposed arcuate relief shape. Portions of each shearing edge of the wave shapes of one plate section of the adapter engage newly formed edges of the cable conductor sheared by the adjacent wave shapes of the other plate section. The cable conductor is sheared at a plurality of locations for axial shear lengths of for example 0.25 inches and substantially without great bulk deformation of the metal thereof during the shearing process. Also since the shearing is axial with respect to the cable when the adapter is terminated on an end of the cable, the cable is not materially weakened. Essentially the intermeshing adapter wave shapes form a plurality of interlocking wave joints with the cable conductor thus defining a strong termination transversely across the cable, with the opposing plate sections acting as a zero clearance tool and die which will resist opening thereafter.

In the first embodiment of the adapter of U.S. Pat. No. 4,867,700 a pair of malleable, high copper content insert members are affixed to and predisposed against the outwardly facing surfaces of the respective plate sections of the stamped and formed adapter body member, along and across the terminating or wave regions thereof. Each insert member is shaped to conform to the wave region of the associated plate section by having conforming wave shapes and by having apertures within which the arcuate relief shapes are disposed. The insert members are adapted to establish the primary electrical connections to the cable conductor, while the transition adapter body member provides the strong mechanical means of attachment to the cable.

It is desirable to provide a method for assuring the integrity of the electrical connections between the insert members and the exposed sheared conductor edges.

It is also desirable to provide a method for assuring the securing of the insert members to completed termination.

It is further desirable to provide a method for affixing the insert members to the transition adapter body member prior to cable termination.

SUMMARY OF THE INVENTION

The present invention is a method of deforming the insert members during cable termination by a transition adapter of the type disclosed in U.S. Pat. No. 4,867,700 by staking the insert members after the cable has been sheared by the adapter body member and sheared integral strips of conductor have been deflected out of the plane of the cable exposing sheared conductor edges beside side surfaces of the insert members. Each wave shape of the insert member is staked by a pointed chisel blade from the outwardly facing surface to expand the wave shape tightly and fully against the sheared conductor edges beside that wave shape on both sides, and also against the adjacent shearing edges of the adjacent wave shapes of the adapter body member.

According to a further aspect of the present invention, preferably prior to staking the wave shapes of the insert members, an operation is performed on the adapter to stake the waves of each wave joint opposed from an insert member wave shape. A pointed chisel blade having an axially oriented tip enters each relief aperture of each insert member and engages and splits axially the arcuate relief shape of the nearer plate section. By splitting the arcuate relief shape the blade creates a pair of spring members having free ends which are forced into the cable conductor tending to at least deform portions of the conductor laterally outwardly against side surfaces of the relief apertures of the nearer insert member and thereafter trap or hold the deformed conductor portions under substantial permanent spring bias against the adjacent insert member surfaces, and also prevents the deflected conductor strip from bulging outwardly along the center where the insert member wave shapes are staked.

According to another aspect of the present invention, the insert members are hermaphroditic, each one having an elongated boss at one end and an elongated aperture at the opposite end, so that during the crimping and staking operation the elongated boss of each insert member enters the elongated aperture of the other. The apertures are appropriately dimensioned and preferably undercut so that upon full entry of the elongated bosses, the bosses are able to be deformed to enlarge the heads thereof to fill the undercut apertures and form joints at the ends of the insert members. Thus each insert member is joined to the other at a gas-tight joint to create a good electrical connection therewith, for transmission of electricity from one insert member to the other and thus between the plate sections of the adapter body member engaged by the insert member surfaces for equalization, without reliance on the hinge joint between the plate sections or incidental engagement of portions of adjacent shearing edges at the wave shapes.

It is an objective of the present invention to provide an adapter for terminating to flat power cable which is easily applied without cable preparation, which results in an assured electrical and mechanical connection to the cable.

It is another objective to provide gas-tight joints between the adapter and the cable conductor which retain substantial stored energy thereat for long-term in-service use and do not relax due to heat and vibration over time.

It is yet another objective to provide an adapter which includes a metal portion capable of being formed to conform tightly against substantially the entire surface area of exposed sheared conductor edges with stored energy after cable penetration.

An embodiment of the present invention will now be described with reference to the accompanying drawings.

DETAILED DESCRIPTION OF THE PREFERRED EMBODIMENT

Figure 1:
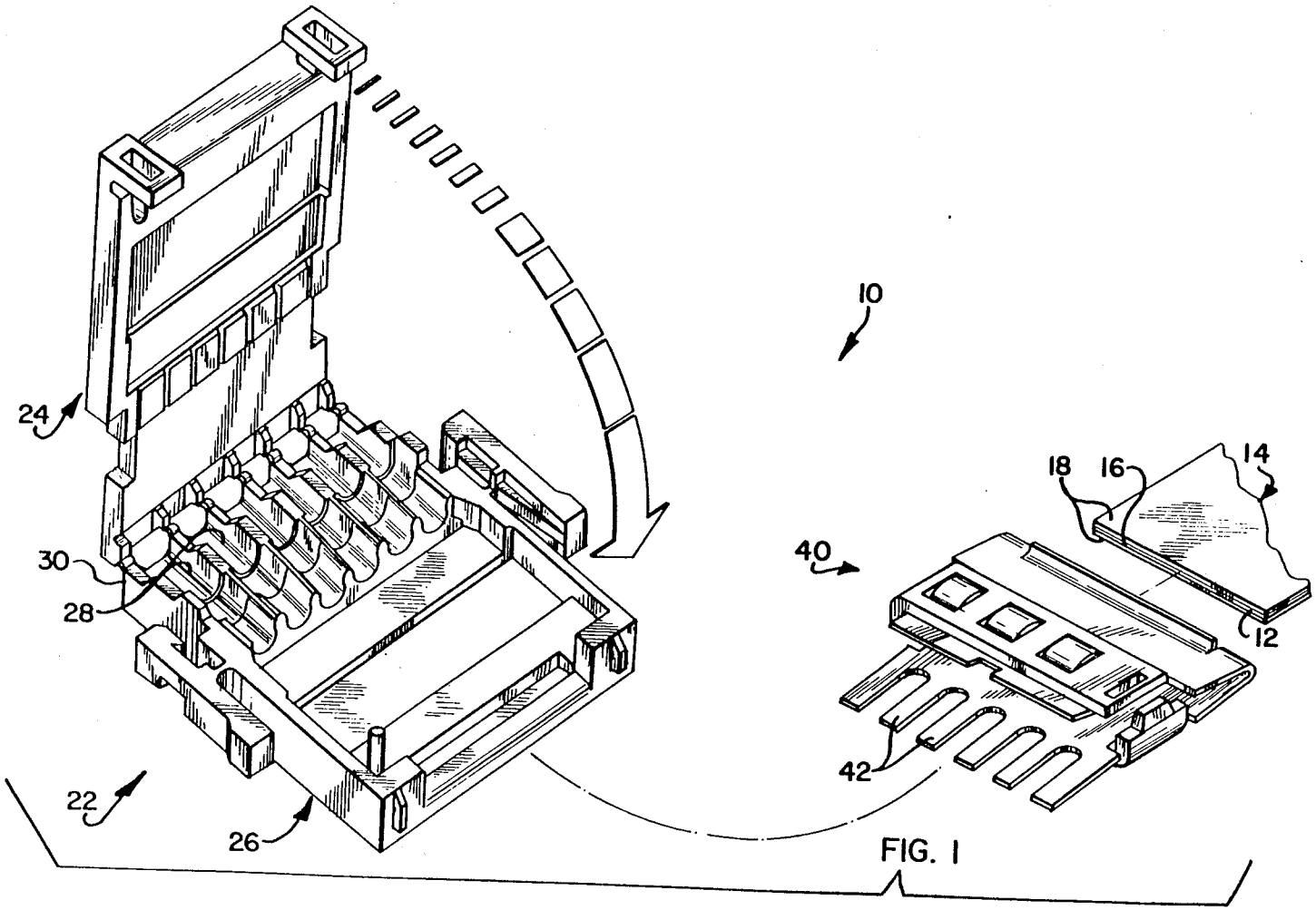
FIG. 1 illustrates an electrical connector for flat power cable utilizing the transition adapter of the present invention.

FIG. 1 illustrates the connector assembly 10 in which the transition adapter 40 of U.S. Pat. No. 4,867,700 assigned to the assignee hereof. Transition adapter 40 is used to terminate an end 12 of flat power cable 14 for a power distribution system for within electronic devices such as computers, copying machines and the like, and also for card cage systems such as that disclosed in U.S. patent application Ser. No. 07/127,992 filed Dec. 2, 1987 and assigned to the assignee hereof. Cable 14 is of the type comprising a flat conductor 16 such as 0.020 inches thick copper or aluminum with an insulative coating 18 extruded therearound, such as four to eight mils thickness of TEFZEL thermoplastic resin (trademark of E. I. DuPont de Nemours and Company) along each surface. After application of transition adapter 40 onto cable end 12, the terminated end is secured within a dielectric housing assembly 22 comprising first and second cover members 24,26 for example. Cover members 24,26 can be hinged to facilitate being rotated together and latched to enclose the terminated cable end. Passageways 28 extend inward from mating face 30 to contain the contact sections of the adapter for mating to corresponding contacts (not shown). The housing assembly can be configured in accordance with the type of contact section or sections 42 desired to be formed on the adapter 40, and also the particular use to which the connector is to be put. A variety of contact sections for the transition adapter is disclosed in U.S. Pat. No. 4,834,673, assigned to the assignee hereof.

Figure 3:
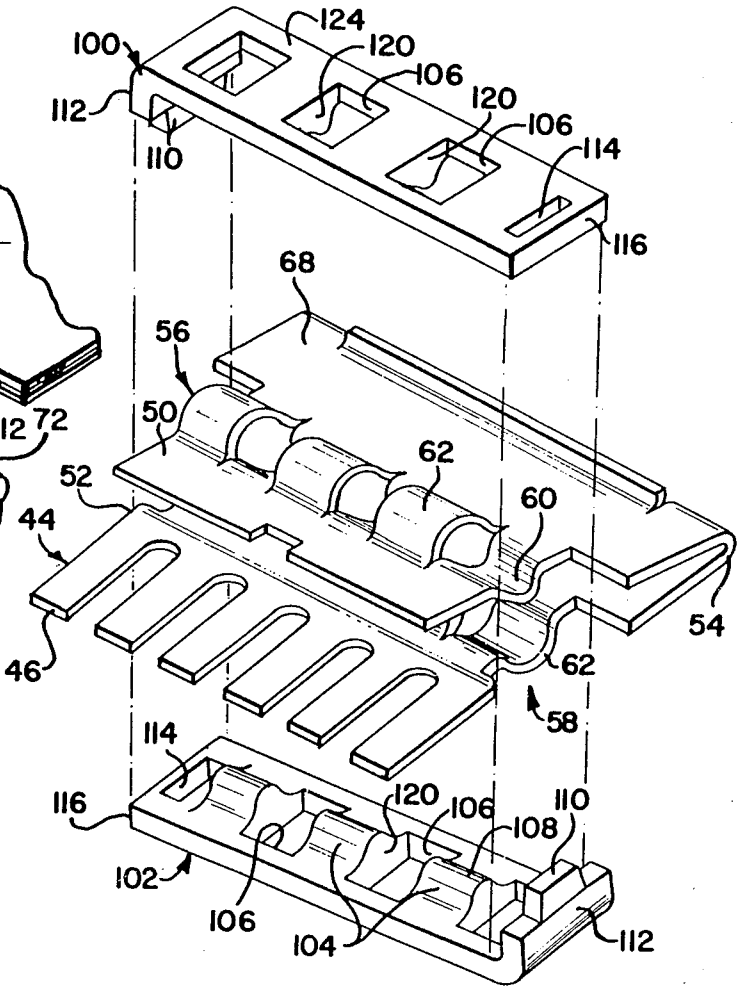
FIG. 3 is an isometric view of the adapter with the insert members exploded from the body member.
Figure 2:
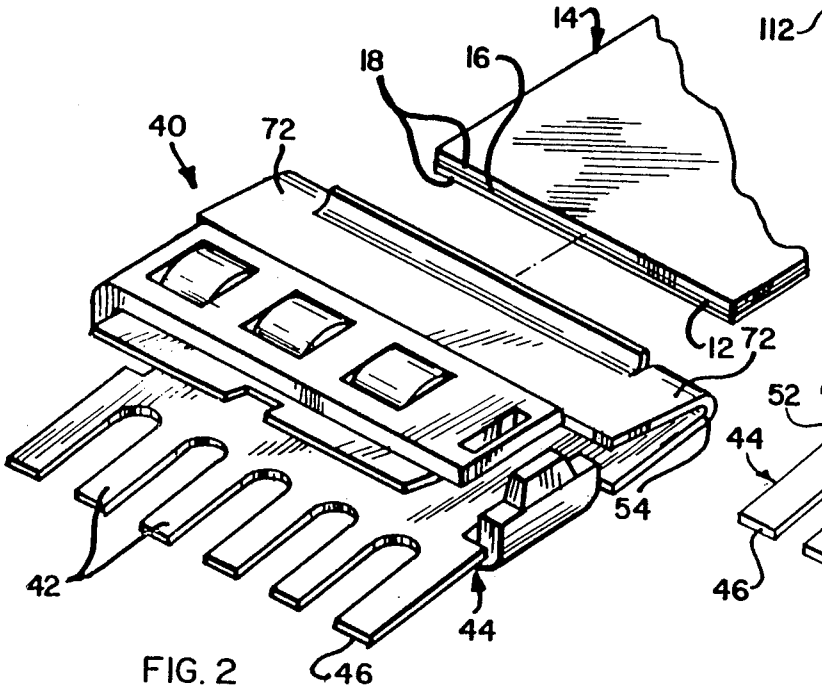
FIG. 2 is an isometric view of the transition adapter of FIG. 1 ready to receive a cable end thereinto for termination.
Figure 11:
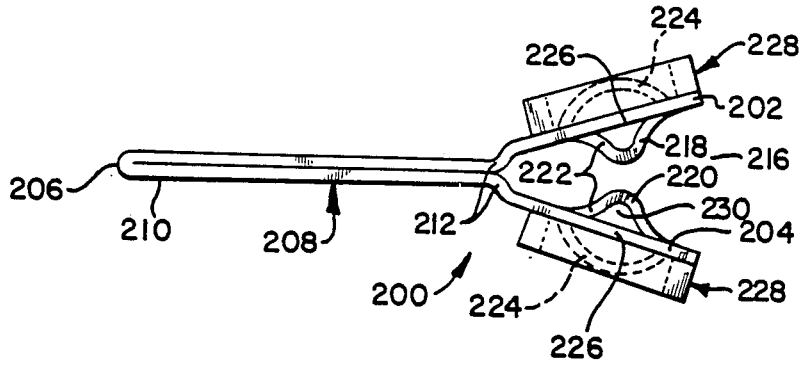
FIGS. 11 and 12 are elevation and isometric views of an alternate embodiment of transition adapter with insert members.
Figure 12:
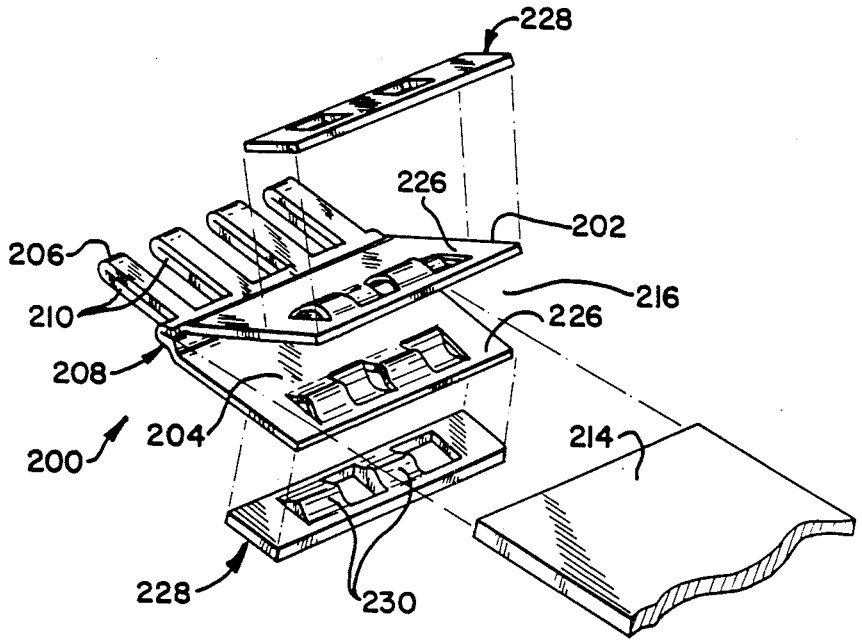

In FIGS. 2 and 3, transition adapter 40 of the present invention includes a body member 44 to which the one or more contact sections 42 are joined or are an integral part, at mating end 46. Body member 44 also includes a cable-receiving end 48 which may be at the opposite end from mating end 46. Body member 44 also includes a pair of plate sections 50,52 preferably integrally joined at hinge 54 so that the plate sections after termination will be disposed in parallel along opposed major side surfaces of cable end 12 and clamped onto cable 14. Preferably and as shown, hinge 54 is located at cable-receiving end 48 although the hinge can also be located proximate mating end 46 as seen in FIGS. 11 and 12.

Plate sections 50,52 have respective opposed terminating regions 56,58 extending transversely thereacross, each comprising a row of spaced wave shapes 60 (see FIG. 6A) alternating with relief recesses formed by arcuate relief shapes 62. Each of the wave shapes of each of the plate sections is located opposed from an arcuate relief shape of the other of the plate sections. The wave shapes of each plate section extend outwardly of the cable-proximate surface 64 thereof and toward the other plate section to radiussed crests 66 (FIG. 6A); the arcuate relief shapes extend outwardly of the cable-remote surface 68 thereof and away from the other plate section. Essentially wave shapes 60 of each of plate sections 50,52 present a cooperating pattern with wave shapes 60 of the other which are offset, and the wave shapes would intermesh if the plate sections were to be urged against each other about hinge 54.

Transition adapter 40 includes insert members 100,102 to establish assured electrical connections to cable conductor 16 affixed to cable-remote surfaces 68 of respective plate sections 50,52 of body member 44 across termination regions 56,58 thereof. Each insert member 100,102 has a pattern of wave shapes 104 alternating with relief apertures 106 likewise presenting a cooperating pattern with those of the other insert member after being secured appropriately to body member 44. Wave shapes 104 include crests 108 and are shaped to conform to the adjacent surfaces of corresponding wave shapes 60 of the plate section to which the insert member is affixed. Preferably each of insert members 100,102 includes a shaped boss 110 at one end 112 and a shaped boss-receiving aperture 114 at the other end 116 so that upon termination the shaped boss of one insert member is received into the boss-receiving aperture of the other.

Figure 6A:
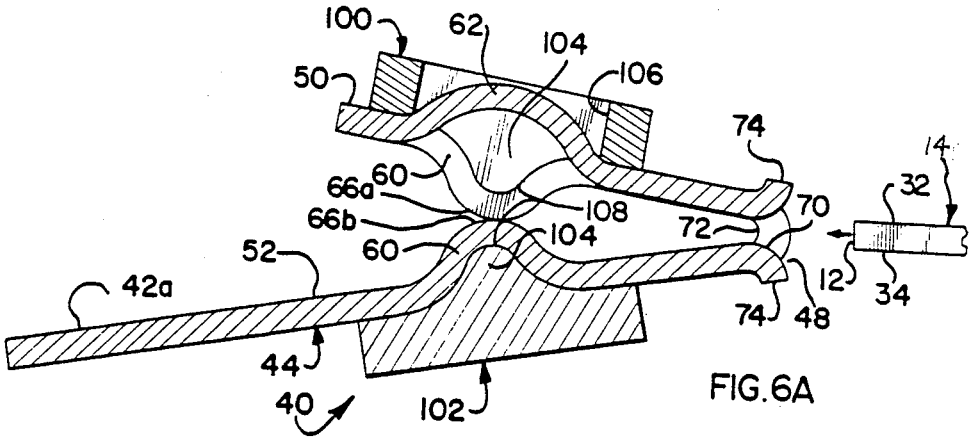
FIGS. 6A to 6C are longitudinal section views of the adapter ready to receive a cable end thereinto, after receiving the cable end, and after being terminated thereonto respectively.

In FIGS. 2 and 6A cable end 12 is insertable into cable-receiving end 48 of transition adapter 40 which preferably comprises a slot 70 (FIG. 4) extending between a pair of hinge sections 72 of body member 44 joining plate sections 50,52 as is described in U.S. Pat. No. 4,859,205. It is preferable that plate sections 50,52 be previously bent almost together about hinge sections 72 prior to cable insertion, with crests 66 of wave shapes 60 close enough together so that the spacing therebetween has a dimension smaller than the thickness of cable 14, so that cable end 12 deflects plate sections 50,52 slightly outwardly against spring bias generated at hinge sections 72 so that transition adapter 44 self-retains onto cable end 12 to facilitate handling prior to the crimping step to follow. Hinge sections 72 should be formed to have a radius about equal to one half of the cable thickness. Outwardly extending flanges 74 along both sides of elongated slot 70 provide strength after termination to provide resistance to plate sections 50,52 being deflected apart resulting from torque which may be applied to the transition adapter due to stresses on the relatively wide, relatively stiff cable.

Figure 4:
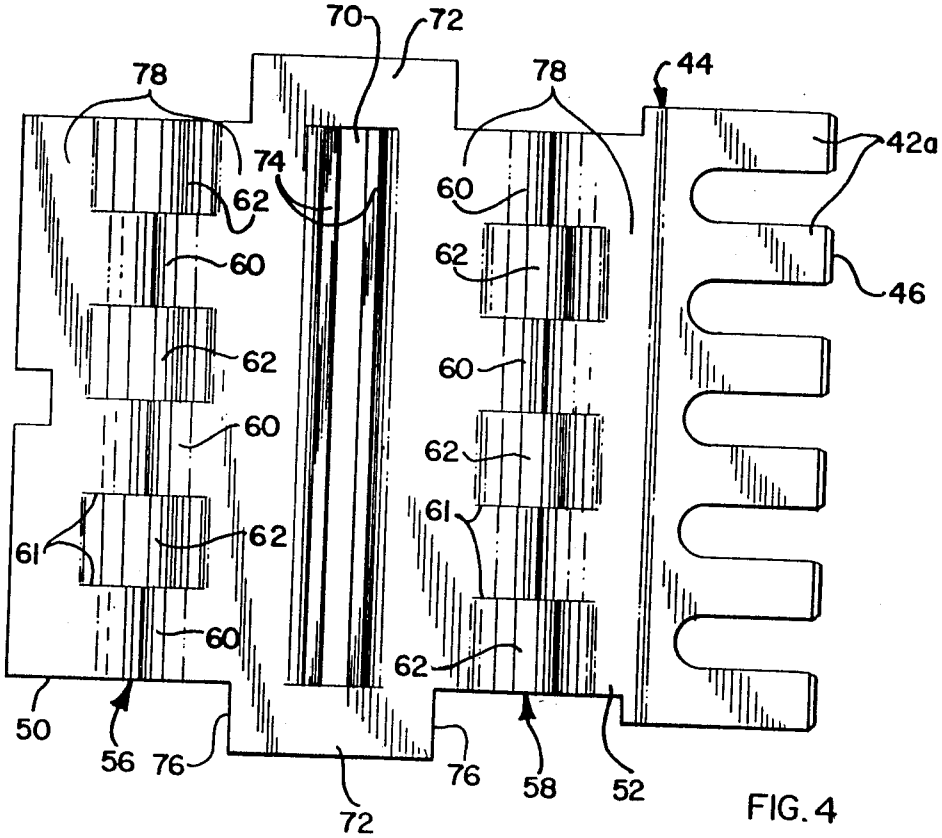
FIG. 4 is a plan view of the body member prior to its plate sections being bent back along each other.

FIG. 4 shows the metal blank of body member 44 prior to application of insert members 100,102 thereto, and prior to being bent at hinge sections 72. Blade type contact sections **42*a* are shown at mating end 46; plate sections 50,52 are shown on either side of slot 70 and flanges 74; and terminating regions 56,58 are seen to have a width across body member 44 about equal to that of a cable, with recesses 76 on either side of hinge sections 72 providing clearance for the bosses 110 of each of insert members 100,102 (FIG. 3) to extend beside body member 44 upon termination to be received in boss-receiving apertures 114 of the opposed insert member. Terminating regions 56,58 are slit at equally spaced, precisely opposed locations during the formation of the wave shapes 60 and arcuate relief shapes 62 in a manner not creating gaps laterally between the formerly joined shearing edges at slits 61. Plate sections 50,52 also include integral portions 78 forwardly and rearwardly of the ends of slits 61. Flanges 74 can be comprised of the metal formed from creating slot 70** and are bent 90° about small radii.

Body member 44 can be formed for example from strip stock of 0.025 inches thick copper alloy such as sold by Olin Corporation under Alloy No. 7025 half hard copper alloy, or such as Alloy No. 151 tempered hard alloy, Temper No. H05 with annealing for good stress relaxation properties. Insert members 100,102 can be formed for example of dead soft Copper CDA 110 generally about 0.066 inches thick with a height at the wave crest 108 of about 0.132 inches, and can have a length in the axial direction of about 0.326 inches. Both the insert members and the body member can be silver plated, if desired, to assure the integrity of the electrical connection for long-term in-service use.

Figure 5:
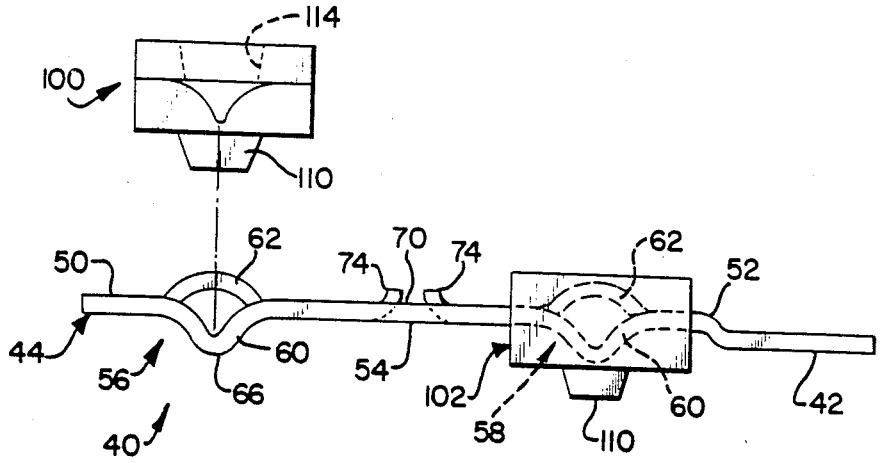
FIGS. 5 and 5A are elevation views showing the insert members being affixed to the body member, and an enlarged isometric part-sectional view thereof illustrating staking.
Figure 5A:
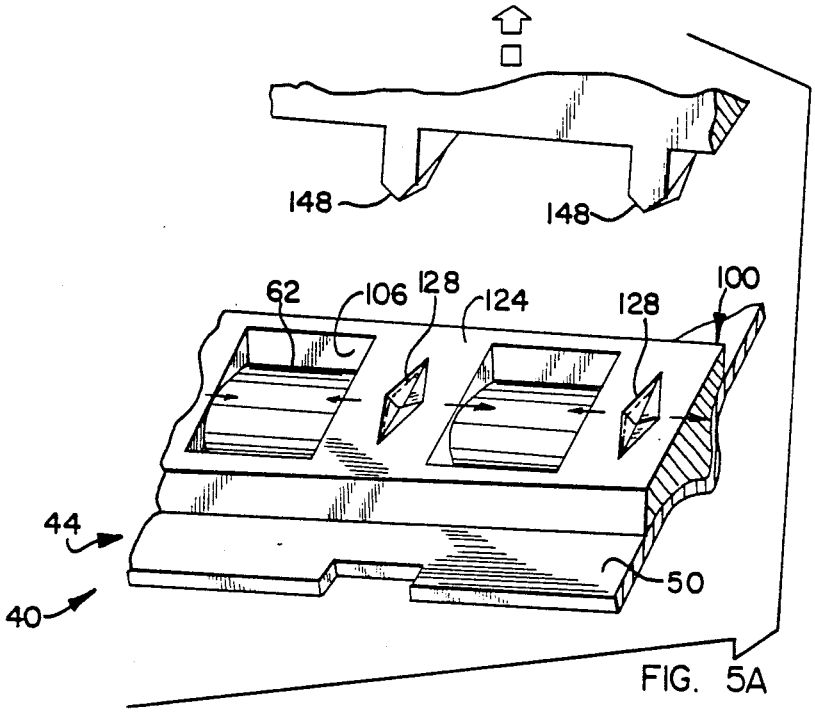

Referring to FIGS. 5 and 5A, each insert member 100,102 can be affixed to a respective plate section 50,52 by a slight staking operation in accordance with the present invention wherein the insert members are tapped by blades 148 centered on the outwardly facing surface of each raised wave shape, which slightly deforms the insert wave shape laterally against the edges of the adjacent arcuate relief shapes of the particular adapter plate section to which the insert member is being secured.

Figure 6B:
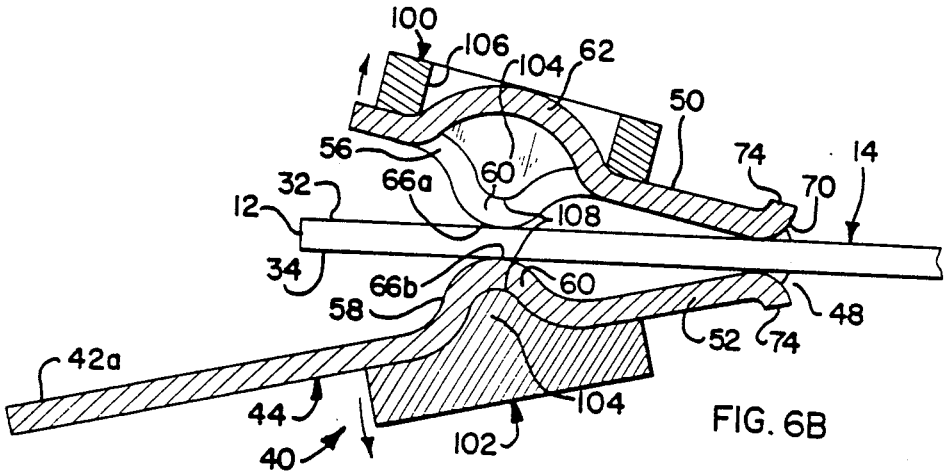
Figure 6C:
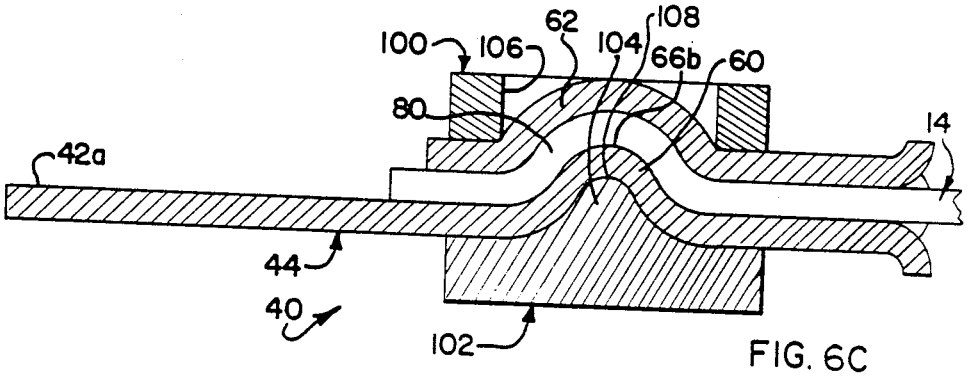

In FIG. 6A the assembled transition adapter 40 is ready to receive cable end 12 into cable-receiving end 48, and wave shapes 60 are almost together at upper and lower crests *66a,66b*. The cable end is inserted into slot 70 and deflects plate sections 50,52 apart in FIG. 6B and is moved forwardly until leading edge 12 is appropriately located a small distance in front of the terminating regions 56,58 but rearwardly of contact sections *42a*. Spring bias at hinge sections 72 creates a gripping of the cable by the crests *66a,66b* against insulated upper and lower surfaces 32,34 of cable 14. In FIG. 6C the transition adapter 40 has been pressed together by tooling 150 (FIG. 7A) such as an arbor press. Shearing edges created by slits 61 along the sides of wave shapes 60 of each plate section have acted in cooperation with those of the offset wave shapes of the opposing plate section and have first punctured and torn the tough, ductile insulative coating 18 of cable 14 and have sheared the cable conductor 16 lengthwise for distances of about 0.25 inches. Crests *66a,66b* have deflected outwardly and elongated the thus sheared portions of cable conductor 16 forming alternatingly upward and downward arcuate conductor loops within the opposed arcuate relief shapes of the opposing plate section. At each wave shape 60 has been formed a wave joint 80. In the present embodiment there are shown six wave joints 80 transversely entirely across cable 14, and the transition adapter of the present invention can easily be modified to create four such wave joints leaving integral adapter straps along lateral ends of the termination regions.

It is believed that the wave shapes assist the shearing of the cable by initiating the outward deflection of the cable in opposite directions first at a single point along the cable axis (by the wave crest) and then gradually axially forwardly and rearwardly therefrom and also by initiating the shearing first at that single point simultaneously with the deflection from both surfaces of the cable by paired shearing edges having zero clearance. The deflected conductor strips remain integrally joined to the cable and the cable is not materially weakened. The termination is considered to be controlled and precise and is performed by shearing edges of the adapter itself and without any prior preparation of the cable required. Another benefit of the present invention is that since the transition adapter grips the cable after cable insertion, handling to place the cable end into the application tooling is simplified since the stiff cable itself is used for manipulation.

The method of the present invention is illustrated with reference to FIGS. 7A to 7C.

Figure 7A:
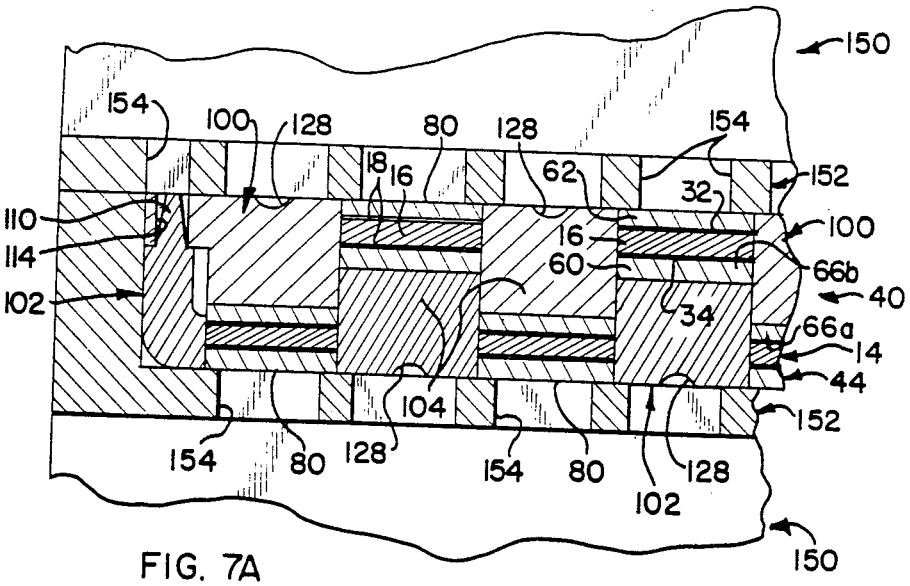
FIGS. 7A to 7C are cross-sectional views taken across the region of the wave termination showing respective shearing and two staking operations of the present invention.
Figure 7B:
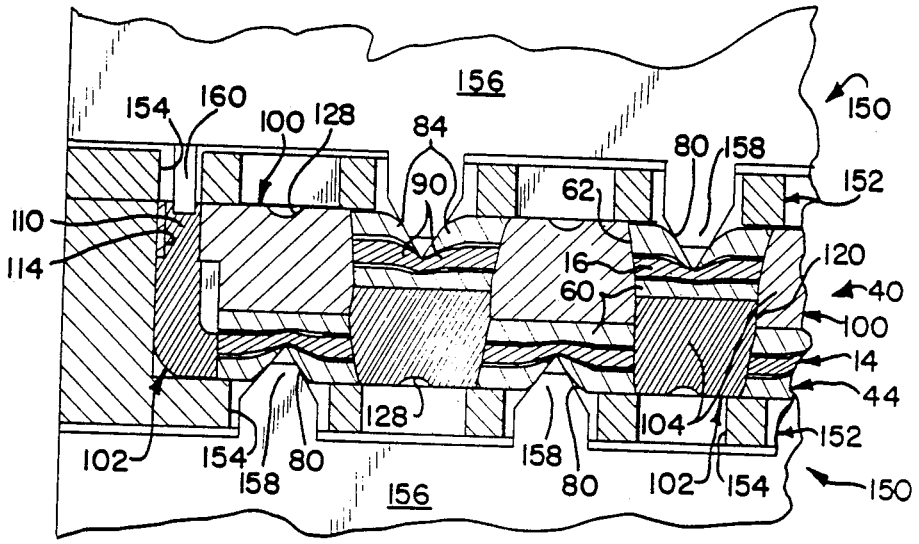
Figure 8A:
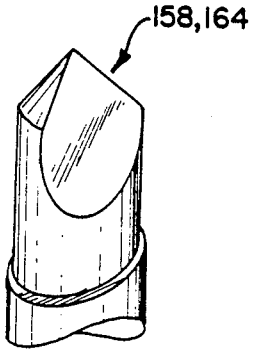
FIGS. 8A and 8B are views of the two types of staking blade tips for use in the staking operations of FIGS. 7B and 7C.
Figure 8B:
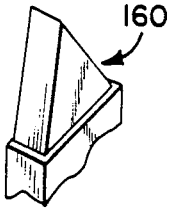
Figure 10:
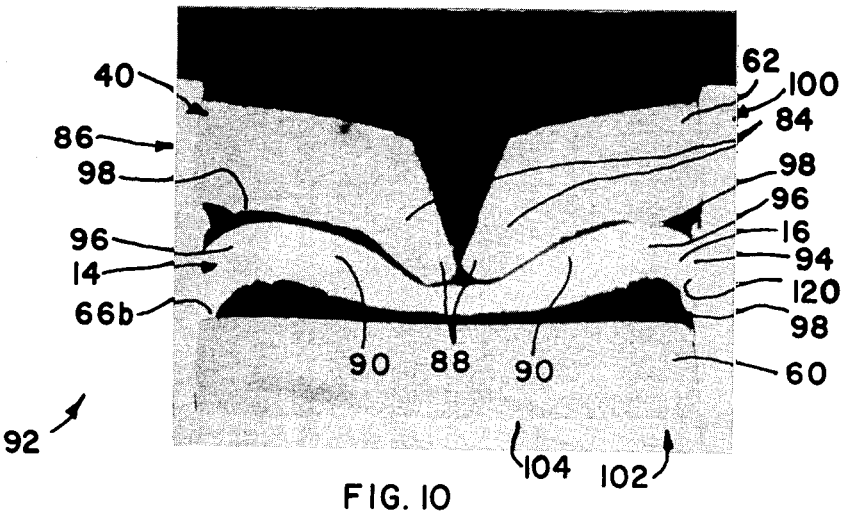

Following the application of compressive force by planar surfaces of a first pair of dies 152 of tooling 150 to shear the cable, preferably dies 152 remain locked together continually pressing most of the outer surfaces of the upper and lower portions of the transition adapter 40 against the upper and lower cable surfaces 32,34. Dies 152 may preferably have limited apertures 154 at each location of wave joint 80 and insert wave shape 104 and at both insert ends 112,116 to expose bosses 110 and the wave joints and insert wave shapes for subsequent staking operations. A second step is then performed by a second pair of dies 156 in FIG. 7B. Pointed chisel blades 158 have axially oriented tips (FIG. 8A) and simultaneously strike the transition adapter 40 from both above and below at each wave joint 80 first along the outer surfaces 82 of arcuate relief shapes 62. Referring to FIGS. 7B and 10, blades 158 penetrate into each wave joint 80 a selected depth and split the arcuate relief shapes 62 and also bend the split portions 84 down along the inside of the resultant V-shape of a staked wave joint 86 at the axial center of the wave. Split portions 84 act as paired spring members having free ends 88 which are permanently deformed by blades 158 into cable 14. With the wave crest 66 of the opposing wave 60 acting as a die, free ends 88 act on softer conductor 16 to urge portions 90 thereof laterally outwardly even though conductor portions 90 may usually remain integrally joined to each other. Spring members 84 thereafter trap conductor portions 90 against side surfaces 120 of insert member relief apertures 106 and retain them against surface 120 under spring bias, acting as stiffly compliant structures. At the same time an additional set of blades 160 (FIG. 8B) stake bosses 110 into boss-receiving apertures 114 of insert members 100,102, thereby deforming the bosses into enlarged shapes within the undercut apertures and firmly joining the inserts together at assured electrical and mechanical joints 122.

Figure 7C:
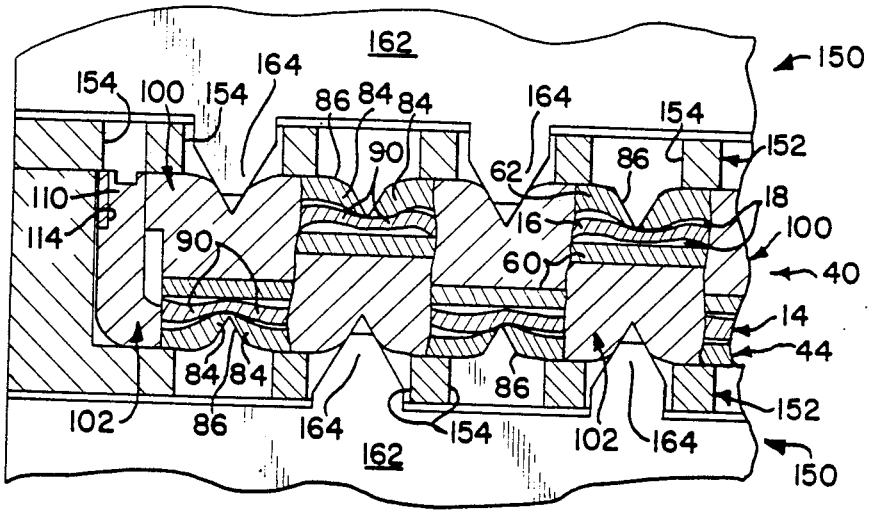

Then as is shown in FIG. 7C, as blades 158,160 are withdrawn but dies 152 remain closed, a third step is performed by a third pair of dies 162 of tooling 150. Pointed chisel blades 164 have axially oriented tips (FIG. 8A) and simultaneously strike the transition adapter 40 from above and below along the outer surfaces 124 of each insert member 100,102 at each wave shape 104 and between the now-staked wave joints 86. Blades 164 thus are struck into the wave shapes 104 of insert members 100,102 and deform the softer copper material laterally and load the contact interface between the freshly sheared edges of the cable conductor portions 90 along each staked wave joint 86 and the relief aperture side surfaces 120 of the insert members. Free ends 88 of spring members 84 also prevent the deflected conductor strips from bulging outwardly at the center during staking of the insert member wave shapes 104. Blades 158,160,164 may optionally be separate members urged into blade-receiving apertures 154 by a separate comb member (not shown).

Figure 9:
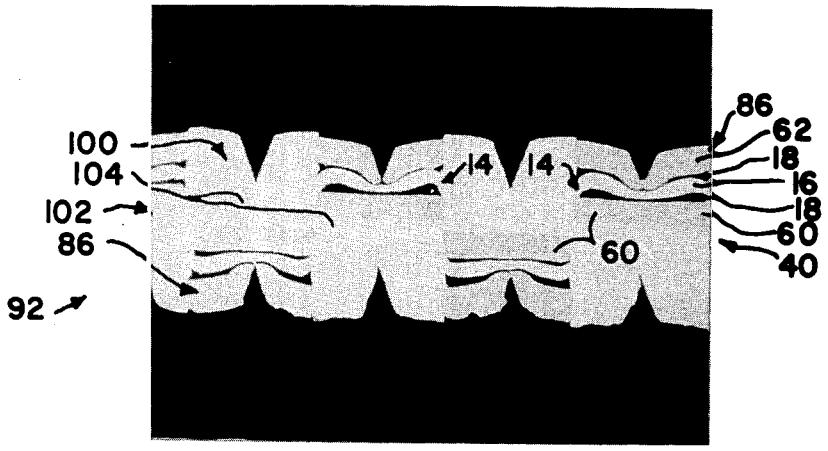
FIGS. 9 and 10 are microphotographs taken along a cross-section of a cable to which a transition adapter has been terminated as in FIGS. 7A–C, and an enlargement of a single staked wave joint thereof, respectively.

FIG. 9 is an enlarged cross-sectional view transversely through an actual termination 92 and represents the type of termination resulting from the transition adapter described with respect to FIGS. 7A to 7C. Four of the six staked wave joints 86 are seen. In FIG. 10 which is an enlargement of one of the staked wave joints 86 of FIG. 9, sheared conductor edges 94 are clearly shown tightly against adjacent side surfaces 120 of adjacent insert wave shapes forming the primary electrical connections 96 between the transition adapter and the conductor of the cable. Near the axial center of each staked wave joint 86, the conductor 16 consists of two portions 90 which have been urged laterally outwardly with sheared conductor edges 94 being impacted against surfaces 120; the curvature at 96 indicates the existence of substantial column strength creating stored energy cooperating with the adjacent staked insert portions to form an assured electrical connection. Dark layered areas 98 within staked wave joints 86 comprise portions of insulative cable covering 18 which have become lodged within available spaces and do not affect the assured mechanical and electrical connections. Measurement of resistance levels of terminations formed in this manner indicate acceptably small levels of voltage drop, indicating good electrical connections after aging at elevated temperatures. Conventional thermal shock tests indicate excellent mechanical stability in the terminations.

FIGS. 11 and 12 show an alternate embodiment of transition adapter 200 in which plate sections 202,204 are integrally joined at bight sections 206 at the forwardmost end of body member 208. Contact sections 210 comprise pin shapes and are formed of double thicknesses of the metal blank from which body member 208 is stamped, and extend rearwardly from bight sections 206 which constitute the leading ends of contact sections 210. Upper and lower plate sections 202,204 are bent upwardly at bends 212 located just rearwardly of contact sections 210 so that they diverge extending rearwardly. Cable end 214 is inserted from cable-receiving end 216 to be disposed between opposed termination regions 218,220 of upper and lower plate sections 202,204 respectively. When plate sections 202,204 are crimped onto cable end 214, wave shapes 222 will then shear cable end 214 at a region which is spaced rearwardly from the forwardmost portion of cable end 214, at a plurality of locations thereacross, and deform the thus-sheared axial strips against the inner surfaces of opposed arcuate relief shapes 224, as in the embodiment of FIGS. 2 to 7C. Four such wave shapes 222 are shown, with integral plate section straps 226 extending laterally beside the terminating regions to assist maintaining insert members 228 thereon which have been affixed to the outer surfaces of plate sections 202,204 of body member 208, although without bosses and boss-receiving apertures at ends thereof. The wave joints can then be staked and the insert member wave shapes 230 can then also be staked as in FIGS. 7A to 7C and according to the present invention. Cable strain relief can be provided by the connector assembly into which the terminated cable end is to be secured, as disclosed in U.S. Pat. No. 4,834,673.

Figures 13A, 13B, 13C:
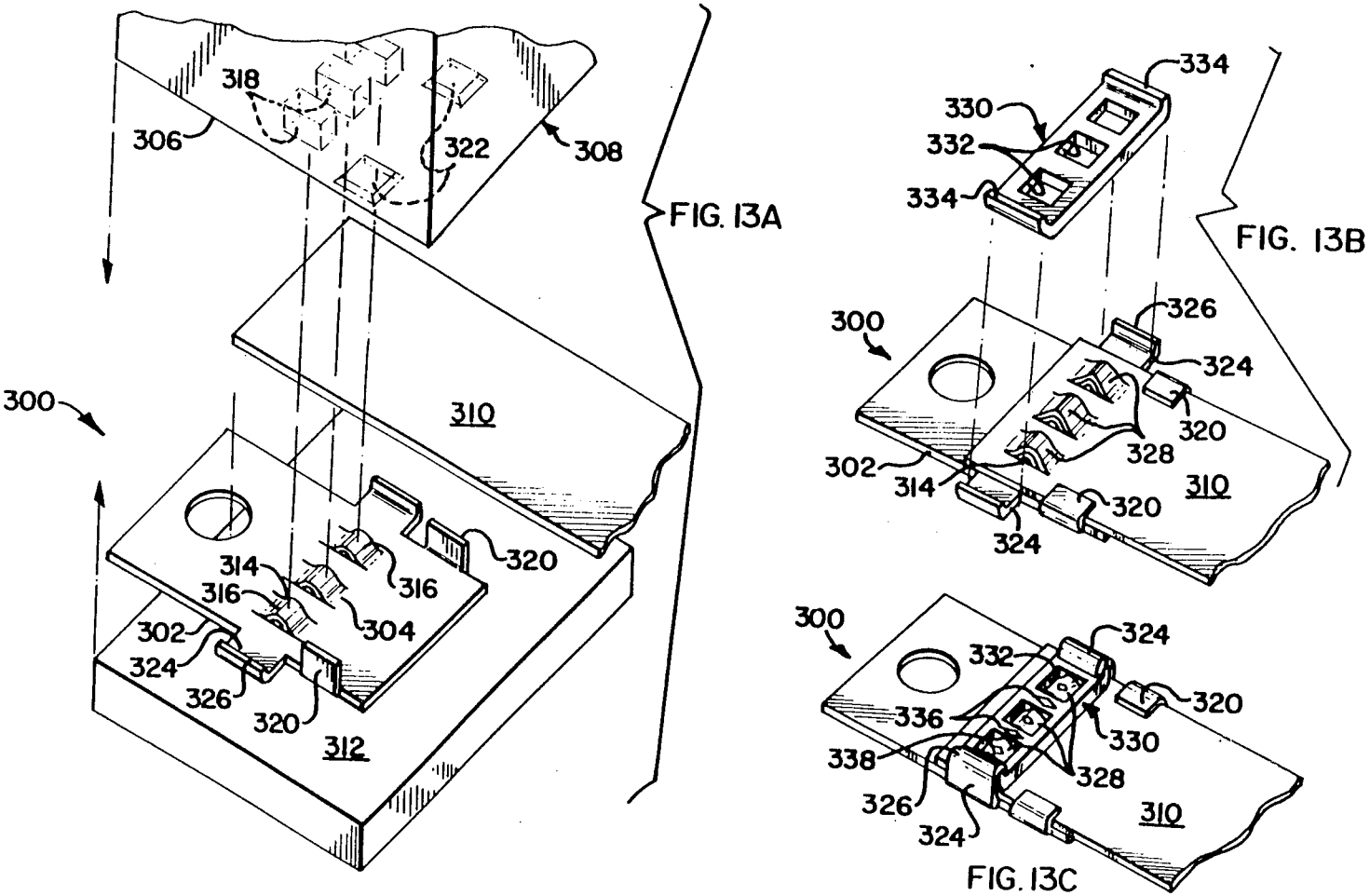
FIGS. 13A to 13C illustrate a transition adapter having one plate section to be joined to a cable using an opposing die, and thereafter having a copper insert member secured to the terminated cable region and then staked.

In FIGS. 13A and 13C a transition adapter 300 has only one plate section 302, with one terminating region 304 thereacross although a plurality of spaced terminating regions may be desired. A die surface 306 of a die means 308 supports cable 310 while plate section 302 is applied under sufficient pressure by another die means 312 against cable 310. Crests 314 of waves 316 deflect adjacent cable portions into relief recesses 318 of die surface 306 as edges of waves 316 shear the cable conductor. Additional cable-securing means such as tabs 320 of adapter 300 may be used, which are bent around side edges of cable 310 by recesses 322 of die surface 306. Also conventional cable-piercing lances (not shown) may be used for securing as in U.S. Pat. No. 4,834,673. By shearing the cable conductor at a plurality of locations across the terminating region 304 and then deflecting the sheared conductor strips 328 out of the plane of the cable, edges of the conductor strips 328 are now exposed to be electrically connected. An insert member 330 having relief apertures 332 can then be placed across the wave region so that sheared and deflected conductor strips 328 are received in respective relief apertures 332, and the cable-proximate surface of insert member 330 is planar. Insert member 330 can then be secured to the termination by tabs 324 of adapter 300 being bent upward and over ends of the insert member so that tab flange portions 326 can be secured around upstanding insert flange portions 334, as seen in FIG. 13C. Insert member 330 can now be staked beside its relief apertures 332 as shown in FIG. 7C, leaving impressions 336; also, the conductor strips 328 can be staked similarly to the wave joint staking shown in FIG. 7B, leaving impressions 338, forming an assured electrical connection.

Insert members having a different configuration may be used in accordance with the present invention. The plate sections can have two terminating regions instead of one, if desired, and can be separate members. Further, it is easily seen that an embodiment of the transition adapter can be terminated to a side edge of a flat cable rather than an end portion. Other modifications to the embodiments described herein may be made without departing from the spirit of the invention or the scope of the claims.

What is claimed is:

1. A termination of a terminating member to a flat power cable of the type having a flat conductor, comprising at least one terminating member disposed at least proximate a respective major surface of said flat cable, each said at least one terminating member being of relatively soft and deformable metal having good conductive properties and having a body section including an array of spaced apertures, said flat cable including a corresponding array of sheared and deflected conductor strip portions extending outwardly from the plane of said cable and exposing sheared conductor edges thereof, respective ones of said sheared and deflected conductor strip portions being disposed within respective said apertures of said terminating member with sheared conductor edges being laterally adjacent side surfaces of said apertures, and said terminating member being staked from a cable-remote surface beside said side surfaces of each said aperture and thereby being bulk deformed against said exposed edges of said sheared and deflected conductor strips, forming gas-tight electrical connections between said exposed sheared conductor edges and adjacent ones of said side surfaces of said terminating member apertures.

2. A termination as set forth in claim 1 comprising two said terminating members disposed along opposed major surfaces of said flat cable having respective arrays of sheared conductor strips deflected outwardly from said opposed major surfaces and disposed within respective apertures of said terminating members, and said two terminating members being staked and thereby being bulk deformed against exposed edges of said sheared and deflected conductor strips of said respective arrays, forming gas-tight connections between said exposed sheared conductor edges and adjacent ones of said side surfaces of said apertures of said two terminating members.

3. A method for providing an assured electrical connection between an electrical terminating member and flat power cable of the type having a flat conductor with a thin insulative covering thereover, terminating the conductor for electrically interconnecting the conductor to another electrical article for the transmission of power, where the terminating member is of the type having a body member of relatively soft and deformable metal having good conductive properties and capable of being bulk deformed and including an array of spaced apertures, the method comprising the steps of:

preparing the flat cable by shearing the cable at a plurality of parallel spaced locations for selected lengths to define an array of conductor strip portions having sheared conductor edges and deflecting said sheared conductor strip portions outwardly of the plane of the cable in at least one direction so that the sheared conductor edges thereof are exposed for electrical connection therewith;

placing the terminating member at least proximate a major surface of the flat cable having said array of spaced and deflected conductor strip portions, so that the apertures of the aperture array receive thereinto respective ones of said sheared and deflected conductor strips with the sheared conductor edges laterally adjacent side surfaces of said apertures; and staking said body section of said terminating member at each location between the apertures thereof, from a cable-remote surface thereof, to deform portions thereof laterally toward and against adjacent ones of the sheared and deflected conductor edges within said apertures, creating gas-tight electrical connections between the sheared conductor edges and the side surfaces of the terminating member apertures.

4. A method for providing an assured electrical connection between an electrical terminal member and flat power cable of the type having a flat conductor with a thin insulative covering thereover, terminating the conductor and electrically interconnecting the conductor to another electrical article having contact means matable with contact means of the terminal for the transmission of power, where the terminal is of the type having a body member having plate sections to be disposed along major surfaces of the cable after termination, each plate section having a terminating region including an array of spaced bosses extending outwardly toward major surfaces of the cable, the bosses adapted upon the plate sections being pressed toward each other and against the cable therebetween to be disposed against major surfaces of respective strips of the cable conductor sheared to define sheared conductor edges and deflected out of the plane of the cable exposing the sheared conductor edges for electrical connection, the terminal further having insert members along cable-remote surfaces of the plate sections, each insert member being of relatively soft and deformable metal having good conductive properties and capable of being bulk deformed, and each said insert member having a body section including relief apertures to receive thereinto respective ones of the sheared and deflected conductor strips during termination so that sheared conductor edges are disposed laterally adjacent side surfaces of the relief apertures, the method comprising the steps of:

pressing the plate sections of the adapter together to dispose the sheared and deflected conductor strips into the relief apertures of the insert members and to move the sheared conductor edges to positions laterally adjacent respective side surfaces of the relief apertures;

staking each insert member at each location between the relief apertures thereof, from a cable-remote surface thereof, to deform portions thereof laterally toward and against adjacent ones of the sheared and deflected conductor edges within the relief apertures, creating gas-tight electrical connections between the sheared conductor edges and the side surfaces of the insert member relief apertures.

5. A method as set forth in claim 4 further including the step prior to said staking step, of staking the portions of the termination exposed along the cable-remote surface of the insert members within said relief apertures to urge portions of the termination laterally outwardly against adjacent ones of the side surfaces of the insert member relief apertures and deform the deflected conductor strips to resist bulging outwardly upon said staking of said insert members.

* * * * *